US008866707B2

(12) United States Patent
Koyama et al.

(10) Patent No.: US 8,866,707 B2
(45) Date of Patent: Oct. 21, 2014

(54) DISPLAY DEVICE, AND APPARATUS USING THE DISPLAY DEVICE HAVING A POLYGONAL PIXEL ELECTRODE

(75) Inventors: Jun Koyama, Kanagawa (JP); Hiroyuki Miyake, Kanagawa (JP); Shunpei Yamazaki, Tokyo (JP)

(73) Assignee: Semiconductor Energy Laboratory Co., Ltd., Kanagawa-ken (JP)

( * ) Notice: Subject to any disclaimer, the term of this patent is extended or adjusted under 35 U.S.C. 154(b) by 960 days.

(21) Appl. No.: 11/389,092

(22) Filed: Mar. 27, 2006

(65) Prior Publication Data

US 2006/0274090 A1 Dec. 7, 2006

(30) Foreign Application Priority Data

Mar. 31, 2005 (JP) ..... 2005-104455

(51) Int. Cl.
*G09G 3/32* (2006.01)

(52) U.S. Cl.
USPC ..... 345/82

(58) Field of Classification Search
USPC ..... 345/82–83, 204–215, 690–699, 41–80; 315/169.3; 313/505; 349/113
See application file for complete search history.

(56) References Cited

U.S. PATENT DOCUMENTS 5,192,945 A 3/1993 Kusada
5,339,181 A 8/1994 Kim et al.
5,576,857 A * 11/1996 Takemura ..... 349/42
5,602,561 A 2/1997 Kawaguchi et al.
5,643,817 A 7/1997 Kim et al.
6,172,729 B1 * 1/2001 Ikeda ..... 349/145
6,456,013 B1 9/2002 Komiya et al.
6,765,549 B1 * 7/2004 Yamazaki et al. ..... 345/80
6,768,482 B2 7/2004 Asano et al.
6,771,241 B2 8/2004 Miyazawa et al.
6,847,343 B2 1/2005 Anzai
6,873,320 B2 3/2005 Nakamura
6,953,949 B2 10/2005 Murade
6,965,365 B2 11/2005 Nakamura
7,002,659 B1 2/2006 Yamazaki et al.
7,009,590 B2 3/2006 Numao
7,057,596 B2 6/2006 Miyazawa
7,075,507 B2 7/2006 Ozawa et al.
7,123,220 B2 10/2006 Hanari et al.
7,301,521 B2 11/2007 Miyazawa et al.

(Continued)

FOREIGN PATENT DOCUMENTS

EP 1098290 5/2001
EP 1298634 A 4/2003

(Continued)

*Primary Examiner* — Chanh Nguyen
*Assistant Examiner* — Long D Pham
(74) *Attorney, Agent, or Firm* — Nixon Peabody LLP; Jeffrey L. Costellia

(57) ABSTRACT

In a display device using a delta arrangement, in a case where a circuit of a large number of elements such as a static memory is arranged every pixel, a wire becomes complicated to cause wiring delay. A shape of a pixel electrode is formed polygonally to arrange in a case where the number of elements such as a static memory is large or in a case where an area of an element required to be included in a pixel is large in a delta arrangement. The shape of the pixel electrode is arranged in a polygon so that a wire along a pixel shape can be used. Even in a case of a pixel with a large number of elements, parasitic resistance of a wire and parasitic capacitance of a wire can be reduced so that wiring delay can be solved.

14 Claims, 14 Drawing Sheets

(56) References Cited

U.S. PATENT DOCUMENTS

| | | | | |
|---|---|---|---|---|
| 7,368,868 | B2 | 5/2008 | Sakamoto | |
| 7,592,990 | B2 | 9/2009 | Miyazawa | |
| 2002/0047965 | A1* | 4/2002 | Suzuki et al. | 349/113 |
| 2002/0070909 | A1* | 6/2002 | Asano et al. | 345/76 |
| 2002/0093472 | A1* | 7/2002 | Numao | 345/87 |
| 2003/0011314 | A1* | 1/2003 | Numao | 315/169.3 |
| 2003/0058200 | A1* | 3/2003 | Numao | 345/76 |
| 2003/0196597 | A1 | 10/2003 | Yamazaki et al. | |
| 2003/0197673 | A1* | 10/2003 | Nakamura | 345/99 |
| 2004/0095364 | A1* | 5/2004 | Koyama et al. | 345/690 |
| 2005/0012445 | A1 | 1/2005 | Yamazaki et al. | |
| 2005/0017992 | A1* | 1/2005 | Kudo et al. | 345/690 |
| 2005/0036088 | A1* | 2/2005 | Okumura | 349/114 |
| 2005/0052605 | A1* | 3/2005 | Okumura | 349/146 |
| 2005/0139924 | A1* | 6/2005 | Kim et al. | 257/347 |
| 2005/0162079 | A1* | 7/2005 | Sakamoto | 313/504 |
| 2006/0214891 | A1 | 9/2006 | Hanari et al. | |

FOREIGN PATENT DOCUMENTS

| | | | |
|---|---|---|---|
| EP | 136577 | A | 11/2003 |
| EP | 1 594 347 | A1 | 11/2005 |
| JP | 01-169433 | A | 7/1989 |
| JP | 04-285917 | | 10/1992 |
| JP | 04-333094 | A | 11/1992 |
| JP | 08-122801 | | 5/1996 |
| JP | 2001-222256 | | 8/2001 |
| JP | 2001-356743 | A | 12/2001 |
| JP | 2002-140036 | | 5/2002 |
| JP | 2002-156954 | | 5/2002 |
| JP | 2002-169503 | | 6/2002 |
| JP | 2002-221917 | | 8/2002 |
| JP | 2003-107505 | | 4/2003 |
| JP | 2003-108031 | | 4/2003 |
| JP | 2003-108032 | A | 4/2003 |
| JP | 2003-108073 | | 4/2003 |
| JP | 2003-208126 | | 7/2003 |
| JP | 2003-302946 | | 10/2003 |
| JP | 2003-337553 | A | 11/2003 |
| JP | 2004-109865 | A | 4/2004 |
| JP | 2004-163601 | | 6/2004 |
| JP | 2006-309182 | A | 11/2006 |
| WO | WO-2004/073356 | A1 | 8/2004 |

* cited by examiner

| | |
|---|---|
| A | B |
| C | D |

FIG. 12A

| | | | |
|---|---|---|---|
| A | A | B | B |
| A | A | B | B |
| C | C | D | D |
| C | C | D | D |

FIG. 12B

| | |
|---|---|
| A | B |
| C | D |

FIG. 13A

| | | | | |
|---|---|---|---|---|
| A | A | A | B | B |
| A | A | A | B | B |
| A | A | A | B | B |
| C | C | C | D | D |
| C | C | C | D | D |

FIG. 13B

| | | | | |
|---|---|---|---|---|
| A | A | B | B | B |
| A | A | B | B | B |
| A | A | B | B | B |
| C | C | D | D | D |
| C | C | D | D | D |

FIG. 13C

| | | | | |
|---|---|---|---|---|
| A | A | A | B | B |
| A | A | A | B | B |
| C | C | C | D | D |
| C | C | C | D | D |
| C | C | C | D | D |

FIG. 13D

| | | | | |
|---|---|---|---|---|
| A | A | B | B | B |
| A | A | B | B | B |
| C | C | D | D | D |
| C | C | D | D | D |
| C | C | D | D | D |

FIG. 13E

| | | |
|---|---|---|
| A | B | C |
| D | E | F |
| G | H | I |

FIG. 14A

| | | | |
|---|---|---|---|
| A | A | B | C |
| A | A | B | C |
| D | D | E | F |
| G | G | H | I |

FIG. 14B

| | | | |
|---|---|---|---|
| A | B | B | C |
| A | B | B | C |
| D | E | E | F |
| G | H | H | I |

FIG. 14C

| | | | |
|---|---|---|---|
| A | B | C | C |
| A | B | C | C |
| D | E | F | F |
| G | H | I | I |

FIG. 14D

| | | | |
|---|---|---|---|
| A | A | B | C |
| D | D | E | F |
| D | D | E | F |
| G | G | H | I |

FIG. 14E

| | | | |
|---|---|---|---|
| A | B | B | C |
| D | E | E | F |
| D | E | E | F |
| G | H | H | I |

FIG. 14F

| | | | |
|---|---|---|---|
| A | B | C | C |
| D | E | F | F |
| D | E | F | F |
| G | H | I | I |

FIG. 14G

| | | | |
|---|---|---|---|
| A | A | B | C |
| D | D | E | F |
| G | G | H | I |
| G | G | H | I |

FIG. 14H

| | | | |
|---|---|---|---|
| A | B | B | C |
| D | E | E | F |
| G | H | H | I |
| G | H | H | I |

FIG. 14I

| | | | |
|---|---|---|---|
| A | B | C | C |
| D | E | F | F |
| G | H | I | I |
| G | H | I | I |

FIG. 14J

DISPLAY DEVICE, AND APPARATUS USING THE DISPLAY DEVICE HAVING A POLYGONAL PIXEL ELECTRODE

BACKGROUND OF THE INVENTION

1. Field of the Invention

The present invention relates to a display device, and particularly relates to a display device having a light-emitting element. In addition, the invention relates to an electronic apparatus including the display device having a light-emitting element.

2. Description of the Related Art

In recent years, a mobile phone is widespread with the advance of communication technology. It is expected that a moving image will be transferred further and more amount of information will be transmitted in the future. On the other hand, a personal computer (PC) for mobile use has been produced due to the weight reduction. An information terminal called a PDA originated in an electronic notebook is produced a lot and being widespread. In addition, with development of display devices, the majority of such portable information devices is provided with a flat panel display.

Moreover, in recent years, in an active matrix display device, productization of a display device using a low-temperature polysilicon thin film transistor (hereinafter a thin film transistor is referred to as a TFT) has been promoted. Since a signal driver circuit can be formed integrally in the periphery of a pixel portion as well as a pixel by using low-temperature polysilicon, downsizing and high definition of a display device are possible, and such a display device is expected to be more widely used in the future.

As for such a display device for mobile devices, a case of displaying such as an electronic book may be considered. In such a case, it has been considered that a screen is kept still, and a controller and a driver for driving the display device are stopped at this time so that reduction of power consumption is achieved. There is a means thereof in which a static memory (typically, an SRAM; however, it is not limited to SRAM) is arranged in a pixel region, and information of a still image is stored in the static memory to keep displaying the still image. The example is described in the following Patent Document 1.

In addition, the portable information device includes in its category a small liquid crystal television, a digital still camera, a video camera, and the like. A display in a delta arrangement is used for a display of the portable information device for displaying such a natural image, in many cases. The delta arrangement is a method to arrange pixels while shifting for each row as shown in FIG. 2. The delta arrangement has been used in many times in displaying a natural image, from the past.

Patent Document 1

Japanese Patent Laid-Open No. 2001-222256

SUMMARY OF THE INVENTION

There is a defect as described below in the aforementioned conventional display device. Six elements are usually required to form a static memory, and six or more elements are required to be arranged in one pixel.

FIG. 2 is a drawing of pixels that a conventional delta arrangement is performed. In FIG. 2, a pixel portion is formed of a pixel electrode 201 and a circuit element 202 to drive the pixel electrode 201.

The delta arrangement is mainly used for AV equipment and has a characteristic in that a natural image is easy to be displayed with a small number of pixels. However, since pixels are arranged while shifting by one-half every other column, a wire for supplying a signal and a wire for supplying power source to elements of a pixel becomes complicated so that much area is required between pixel electrodes, and parasitic resistance and parasitic capacitance of the wires are increased. This can be easily assumed because many parallel wires are arranged in the periphery of the circuit element 202 in FIG. 2.

Particularly, in a case where a static memory is incorporated as mentioned above, this effect becomes further remarkable, and parasitic resistance and parasitic capacitance are increased, which causes to increase signal delay time. Moreover, in a case where even the number of elements is not so large but much area is required in a capacitor or the like, parasitic resistance and parasitic capacitance is increased, which causes to increase delay time similarly.

In view of the aforementioned problems, according to the invention, a delta arrangement is used and even when a plurality of elements such as a static memory is arranged inside a pixel, parasitic resistance and parasitic capacitance is decreased, so that a display device which decreases delay time and an electronic apparatus using the display device are provided.

To solve the aforementioned problems, in the invention, a shape of a pixel electrode is formed polygonally to arrange in a case where the number of elements such as a static memory is large or in a case where an area of elements required to be included in a pixel is large in a delta arrangement.

One aspect of the invention is a display device having a plurality of light-emitting elements in a delta arrangement and a pixel driving element arranged in each of the light-emitting elements. In this display device, shape of at least one electrode of the light-emitting element is a polygon.

One aspect of the invention is a display device having a plurality of light-emitting elements in a delta arrangement and a pixel driving element arranged in each of the light-emitting elements. This display device has respective static memories arranged in accordance with each of the light-emitting elements and shape of at least one electrode of the light-emitting element is a polygon.

In this case, a wire supplying a signal or a wire supplying power to the pixel driving element or the static memory is arranged with diagonal routing along with the polygonal pixel electrode.

Moreover, a pixel electrode preferably has eight sides and has a polygonal shape formed of sides in which a length difference between certain one side and next one side is 20% or less of the certain one side, preferably 10% or less. That is, the pixel electrode is preferably an octagon or a polygon close to the octagon. It should be noted that at least one of corners of the octagon or the polygon close to the octagon may have a round shape.

One aspect of the invention is, in the aforementioned constitution of the invention, a display device having a first display mode to express a high gray scale level and a second display mode to express a low gray scale level, and can switch the plurality of display modes. In this case, there may be configuration in which the first display mode can express 64 or more gray scale levels while the second display mode can express 2 gray scale levels.

As described above, according to the invention, a shape of a pixel electrode is formed to be an octagon, thereby arrangement of elements is performed effectively while performing a delta arrangement, so that parasitic resistance of a wire and parasitic capacitance of a wire can be reduced to suppress increase of delay time even when one or more static memories or the like is arranged in one pixel. In addition, arrangement of elements and wires becomes easy.

BRIEF DESCRIPTION OF THE DRAWINGS

FIGS. 12A and 12B are drawings each showing conversion of a pixel format.

FIGS. 13A to 13E are drawings each showing conversion of a pixel format.

FIGS. 14A to 14J are drawings each showing conversion of a pixel format.

DETAILED DESCRIPTION OF THE INVENTION

Embodiment Mode

Hereinafter, the invention will be fully described by way of an embodiment mode and embodiments with reference to the accompanying drawings. However, it is to be understood that various changes and modifications will be apparent to those skilled in the art. Therefore, unless such changes and modifications depart from the scope of the present invention, they should be construed as being included therein.

Figure 1:
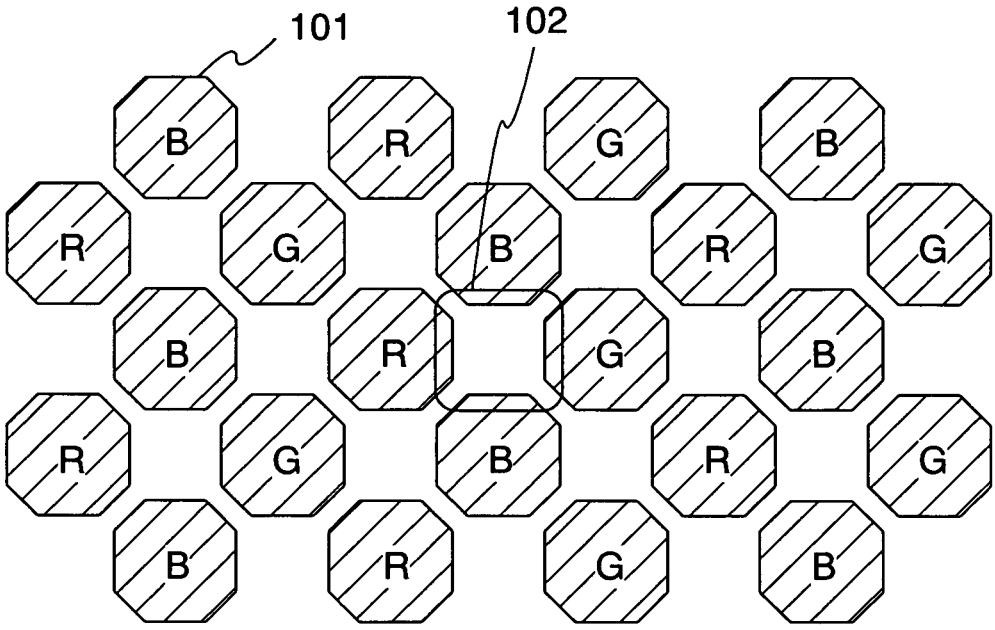
FIG. 1 is a schematic view of pixels in a delta arrangement of the invention.
Figure 2:
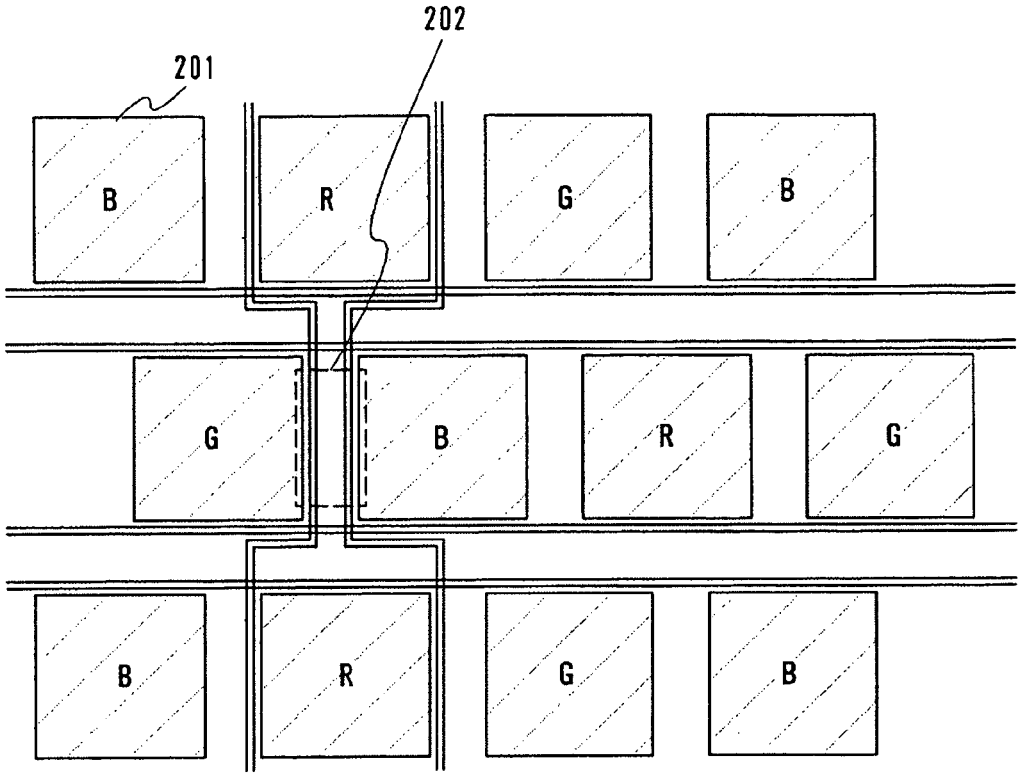
Prior Art FIG. 2
FIG. 2 is a schematic view of conventional pixels in a delta arrangement.

FIG. 1 shows an example of a pixel having an octagonal pixel electrode. Reference numeral 101 denotes one pixel and 102 denotes a place for arranging a circuit to drive a pixel. The region 102 for arranging a circuit can be obtained favorably as shown in FIG. 1, and effective arrangement is possible compared to the aforementioned conventional square or rectangular pixel.

Figure 3:
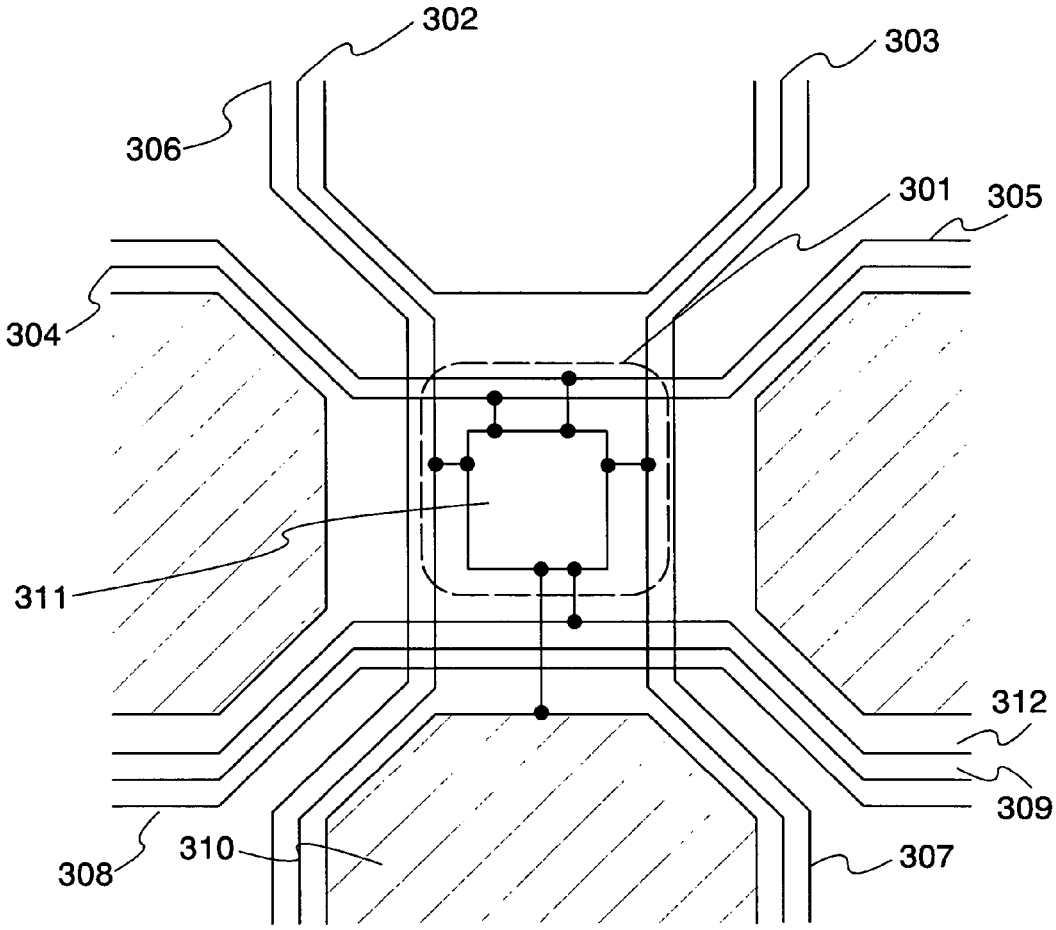
FIG. 3 is an enlarged view of pixels in a delta arrangement of the invention.

FIG. 3 shows a configuration example in a case of enlarging the pixel of FIG. 1. FIG. 3 shows the region 102 of FIG. 1. Reference numeral 310 denotes a pixel electrode and 311 denotes a circuit for controlling a potential of the pixel electrode 310 in FIG. 3. Reference numeral 302 denotes a data line connected to the circuit 311, 307 denotes a data line connected to a circuit for controlling another pixel electrode, 304 denotes a first scan line, and 305 denotes a second scan line. Moreover, 308 and 309 denote scan lines for controlling other pixels. Reference numeral 303 denotes a power supply line, and 306 denotes a power supply line of other pixels. Reference numeral 301 denotes a pixel circuit including wires. Moreover, 312 is a low potential power supply line.

Here, the data lines 302 and 307, the scan lines 304, 305, 308, and 309, the low potential power supply line 312 are formed along with a diagonal side of an octagonal pixel as shown in FIG. 3. With such a shape, generation of unnecessary parasitic capacitance by wire cross and the increase of parasitic resistance by the increase of a wire length can be prevented. In addition, an element and a wire can be easily arranged.

As set forth above, in this embodiment mode, although description is made on an example of a pixel having an octagonal pixel electrode, the invention is not limited to this and a polygonal pixel electrode can be applied thereto. Particularly, a pixel electrode preferably has eight sides and has a polygonal shape formed of the sides in which a length difference between certain one side and next one side is 20% or less than the certain one side, preferably 10% or less. That is, the pixel electrode is preferably an octagon or a polygon close to the octagon. Note that the pixel shape is not limited to a polygon. Even a vertex portion thereof is a roundish shape without an angle; a similar effect can be expected as long as it is roughly a polygon shape.

Embodiment 1

Figure 4:
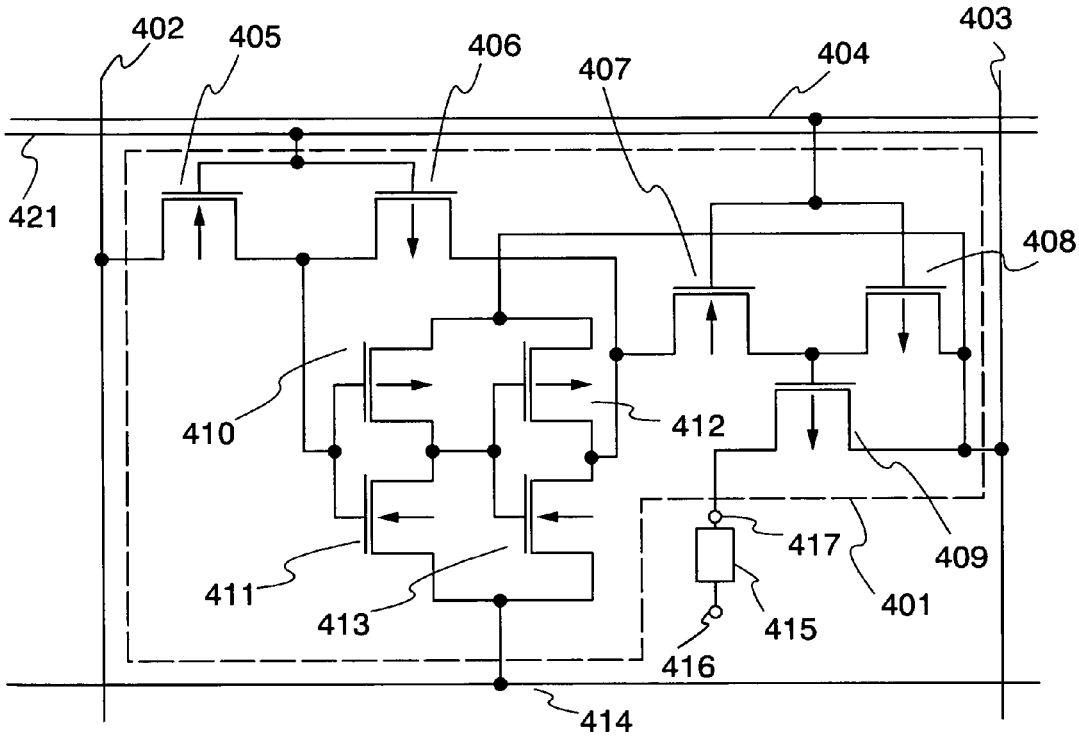
FIG. 4 is a drawing showing an equivalent circuit of an embodiment of a pixel of the invention.

FIG. 4 shows an example of a circuit configuration of 301 shown in FIG. 3. Reference numeral 401 of FIG. 4 corresponds to the circuit 311 of FIG. 3. In FIG. 4, reference numeral 402 denotes a data line, 421 denotes a first scan line, 404 denotes a second scan line, 403 denotes a power supply line, 405 denotes a switch TFT, 409 denotes a driving TFT, 415 denotes a light-emitting element, 417 denotes a first electrode of the light-emitting element, and 416 denotes a second electrode of the light-emitting element. In addition, TFTs 410 to 413 form a static memory. Reference numeral 406 denotes a switch TFT for easily writing to the static memory and uses a TFT with reverse polarity to the switch TFT 405. In addition, 407 denotes a switch TFT for inputting an output of the static memory into a gate of the driving TFT 409. A switch TFT 408 is for connecting the gate of the driving TFT 409 to the power supply line 403, and is used to turn off the driving TFT 409. Reference numeral 414 denotes a low potential power source of the static memory.

In FIG. 4, the switch TFT 405 is turned on or off by a signal of the first scan line 421, thereby, it is determined whether data of the data line 402 is stored in the static memory. Data stored in this static memory and a signal of the second scan line 404 determine whether the driving TFT 409 is turned on or off, and in a case where the driving TFT 409 is turned on, the light-emitting element emits light.

Hereinafter, an operation in the embodiment mode is described. First, description is made on a case of writing data by which the light-emitting element emits light. A low potential signal is inputted to the data line 402. Next, when the first scan line 421 becomes high, the switch TFT 405 is turned on, the low potential of the data line is inputted to an inverter formed of the TFT 410 and the TFT 411, and an output of the inverter formed of the TFT 410 and the TFT 411 becomes high. This inverter output is inputted to an inverter formed of the TFT 412 and the TFT 413. An output of the inverter formed of the TFT 412 and the TFT 413 is low, and inputted to the gate of the driving TFT 409 through the switch TFT 407. The switch TFT 406 is off while the first scan line is high. In FIG. 4, since the driving TFT 409 is a P type TFT, when a low potential is inputted to the gate thereof, the driving TFT 409 is turned on, the first electrode 417 of the light-emitting element and the power supply line 403 are electrically connected to each other, and a current flows to the light-emitting element; therefore, light emission is performed. At this time, the second scan line 404 is high.

Next, description is made on a case of writing data by which the light-emitting element is turned off the light. A high potential signal is inputted to the data line 402. Next, when the first scan line 421 becomes high, the switch TFT 405 is turned on, the high potential of the data line is inputted to the inverter formed of the TFT 410 and the TFT 411, and the output of the inverter formed of the TFT 410 and the TFT 411 becomes low. This inverter output is inputted to the inverter formed of the TFT 412 and the TFT 413. The output of the inverter formed of the TFT 412 and the TFT 413 is high, and inputted to the gate of the driving TFT 409 through the switch TFT 407. The switch TFT 406 is off while the first scan line 421 is high. In FIG. 4, since the driving TFT 409 is the P type TFT, when a high potential is inputted to the gate thereof, the driving TFT 409 is turned off, the first electrode 417 of the light-emitting element and the power supply line 403 are not electrically connected to each other, and a current does not flow to the light-emitting element; therefore, light emission is not performed. At this time, the second scan line 404 is high.

Next, description is made on a case of turning off light of the light-emitting element. When the light-emitting element is turned off light, since the first scan line 421 is low, the switch TFT 405 is turned off, and a potential of the data line 402 is not written to the pixel. The switch TFT 406 is turned on, and data which is already written is held. The second scan line 404 becomes low, the switch TFT 407 is turned off, and the driving TFT 409 and the static memory are cut off. Through the switch TFT 408, a potential of the power supply line 403 is inputted to the gate of the driving TFT 409. Since the driving TFT 409 is the P type TFT, when the potential of the power supply line 403 is inputted to the gate thereof, the driving TFT 409 is turned off, the first electrode 417 of the light-emitting element and the power supply line 403 are not electrically connected to each other, and a current does not flow to the light-emitting element; therefore, the light-emitting element is turned off the light. This embodiment operates as mentioned above. Note that a circuit configuration using a static memory is not limited to this embodiment, and other configuration may be used. In addition, a static memory can hold a storage state unless a power source is cut, so that all of a driver, a controller described below, or the like can be stopped. Thus, in a case of displaying a still image, low power consumption can be achieved.

Embodiment 2

Since an output value of a static memory is a digital value to express 0 or 1, display using the static memory cannot be performed in an analog manner. Therefore, when a gray scale display is performed, a time gray scale method is used. A principle of the time gray scale method is described.

In a case of a time gray scale method, gradation is expressed by changing light emitting time of an element which emits light with a certain constant luminance. For example, when light emits during one frame period entirely, lighting ratio becomes 100%. In addition, when light emits during half period of one frame period, lighting ratio becomes 50%. When the frame frequency is high to some extent, in a case of 60 Hz or more in general, human eyes cannot recognize blinking but recognize a halftone. In this manner, lighting ratio is changed so that the gradation can be expressed.

Figure 5A:
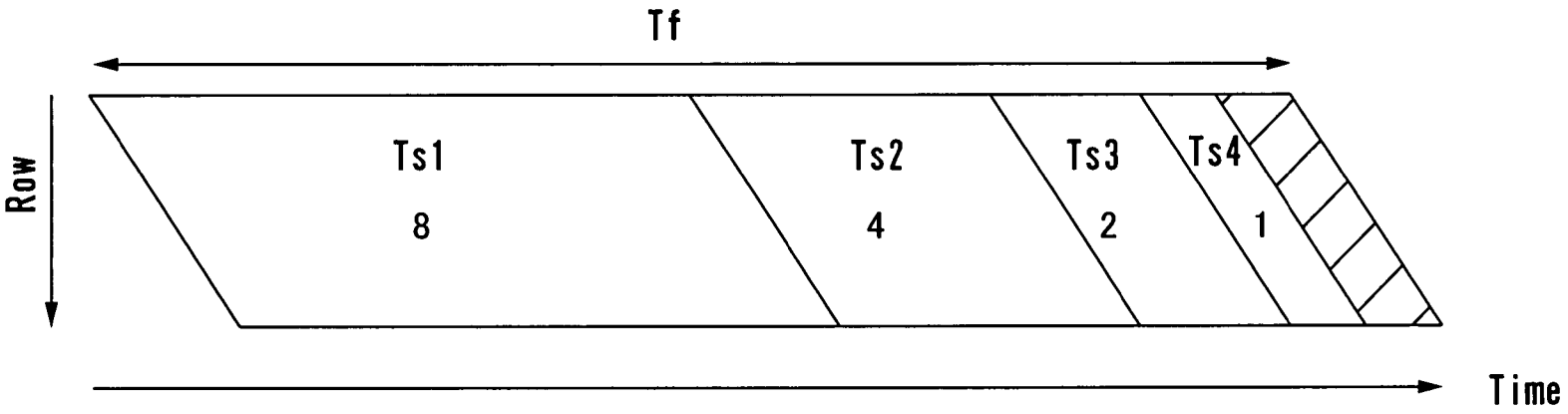
FIGS. 5A and 5B are drawings each showing an embodiment of a subframe of the invention.

In FIG. 5A, an abscissa indicates time and an ordinate indicates pixels arranged in a row direction of a display screen. In this example, writing is performed sequentially from the top in the display screen; therefore, display is delayed. Although writing is performed sequentially from the top in this example, a writing method of the invention is not limited to this. Hereinafter, although description is made while taking 4 bits as an example, the invention is not limited to 4 bits.

In FIG. 5A, one frame is divided into four subframes (Ts1, Ts2, Ts3, and Ts4). Length ratio of the subframe periods is Ts1:Ts2:Ts3:Ts4=8:4:2:1. These subframes are combined so that length of a light emitting period can be set to any of 0 to 15. In this manner, one frame is divided into power-of-two subframes so that the gradation can be expressed.

In addition, since a light emitting period is short in Ts4, before writing of the bottom half of the screen is completed, the top half thereof is required to turn off the light, and writing and erasing are performed simultaneously.

Figure 5B:
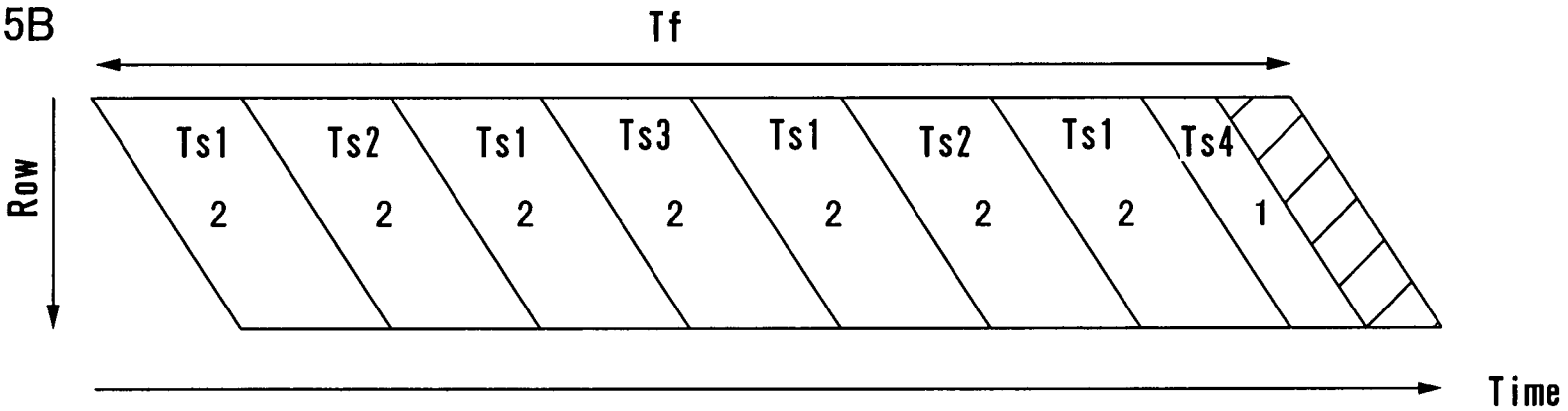

In FIG. 5B, performed is gray scale expression by different time division from FIG. 5A. When a high-order bit is changed in the gray scale expression means of FIG. 5A, a defect called pseudo contour is generated. For example, this means that when human eyes watch a gray scale level of 7 and a gray scale level of 8 alternately, there is an error of sense that an image is seen differently from original gradation.

Therefore, in FIG. 5B, a high-order bit is divided and the aforementioned pseudo contour phenomenon is reduced. Specifically, the most significant bit (here, Ts1) is divided into 4 and arranged within one frame. In addition, the second bit (here, Ts2) is divided in 2 and arranged inside one frame. In this manner, a bit which is long in terms of time is divided and pseudo contour is reduced.

Figures 6A, 6B, 6C:
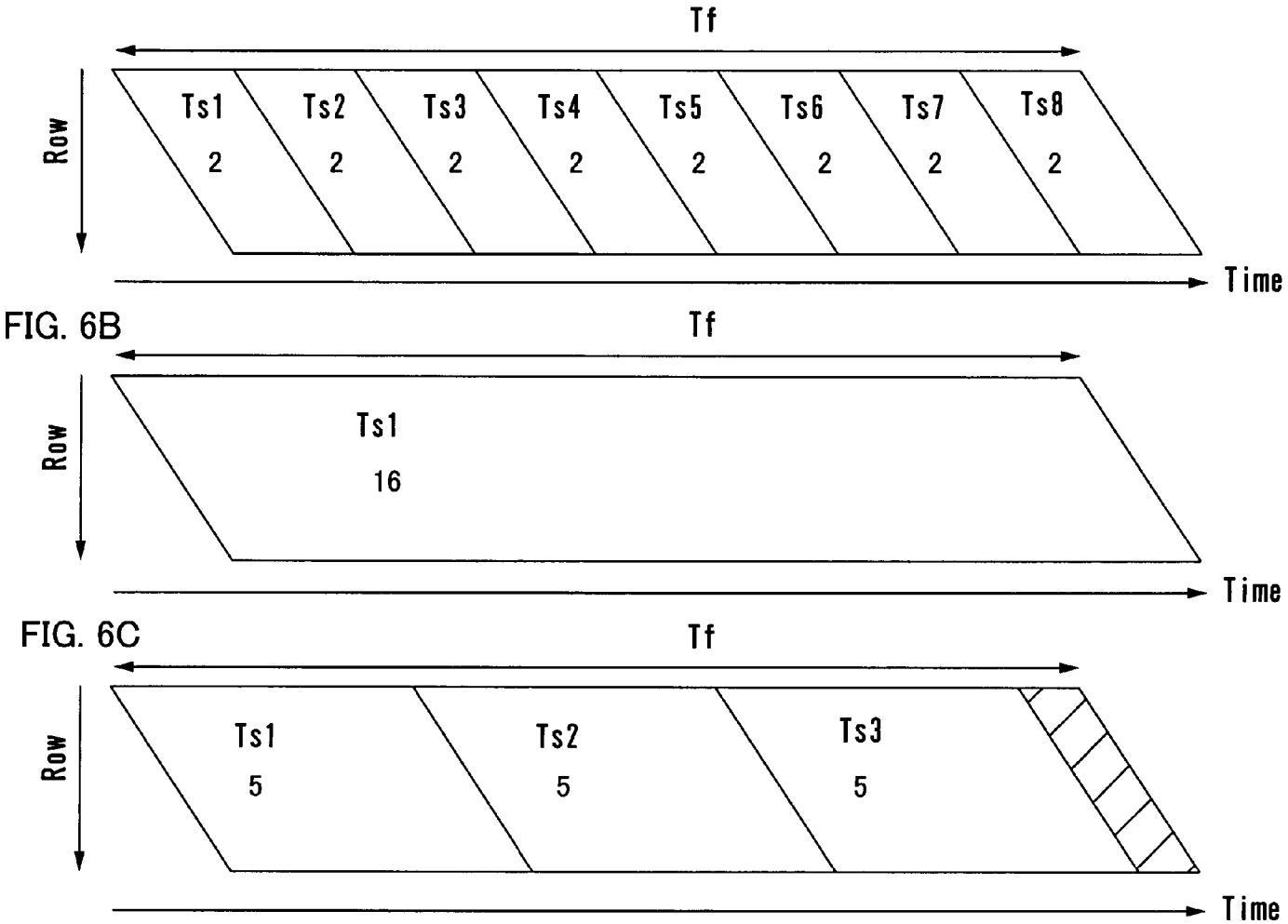
FIGS. 6A to 6C are drawings each showing an embodiment of a subframe of the invention.

In FIG. 6A, subframes are separated at even intervals not with power-of-two spacing so that pseudo contour is not generated. In this method, since there is not a large break of a bit, pseudo contour is not generated but gradation itself becomes rough. That is, since a gray scale is expressed by a multiple of a subframe, a gray scale except a multiple of a subframe cannot be expressed well. Therefore, a gray scale complement is required to be performed using FRC (frame rate control), a dither, or the like.

FIG. 6B is a case of performing only binary display. In this case, since there is only one subframe in one frame, the number of rewriting also becomes one in one frame so that power consumption of a controller and a driver can be reduced. In a case where a natural image is not expressed, since the number of gray scale levels need not be large, display with power consumption prioritized can be performed. Such display and the aforementioned FIG. 5A, 5B, 6A, or the like are combined, so that a case where the large number of gray scale levels is required and a case where only the small number of gray scale levels is required are separately used and power consumption can be reduced.

In FIG. 6C, 4 gray scales are expressed, and display is performed by writing three times in one frame period. This is applied to a case where the number of gray scale levels is required larger than that of FIG. 6B, but not so much as for FIG. 6A, or the like.

In this manner, there are a lot of structure methods of subframes and the invention is not limited to the method described herein. In a time gray scale method, since a signal inputted from a controller can set up the aforementioned method, selection among the aforementioned methods is possible even a display does not have many switching functions.

This embodiment can be freely combined with Embodiment Mode and Embodiment 1.

Embodiment 3

Figure 7:
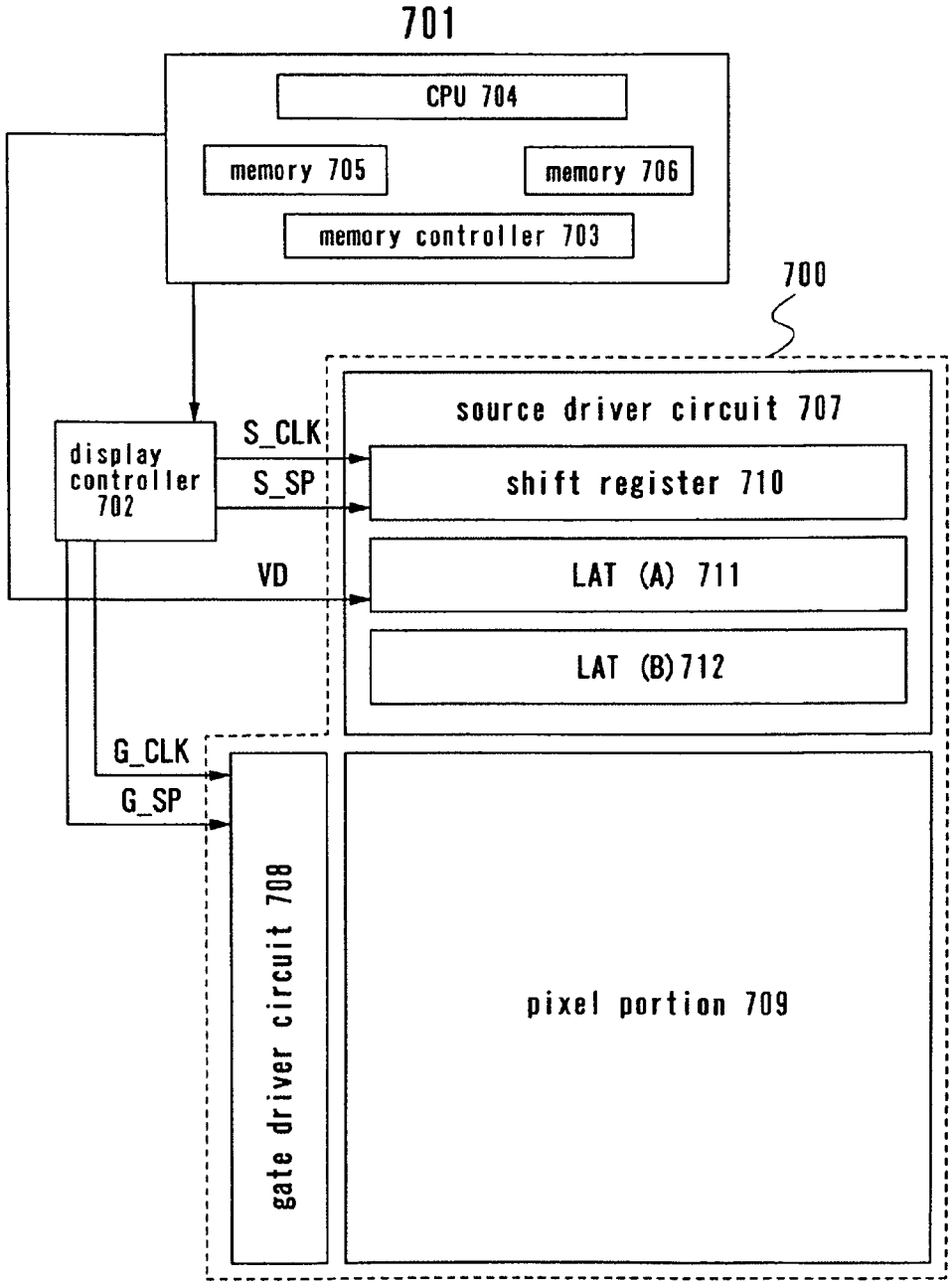
FIG. 7 is a block diagram of a controller.
Figure 8:
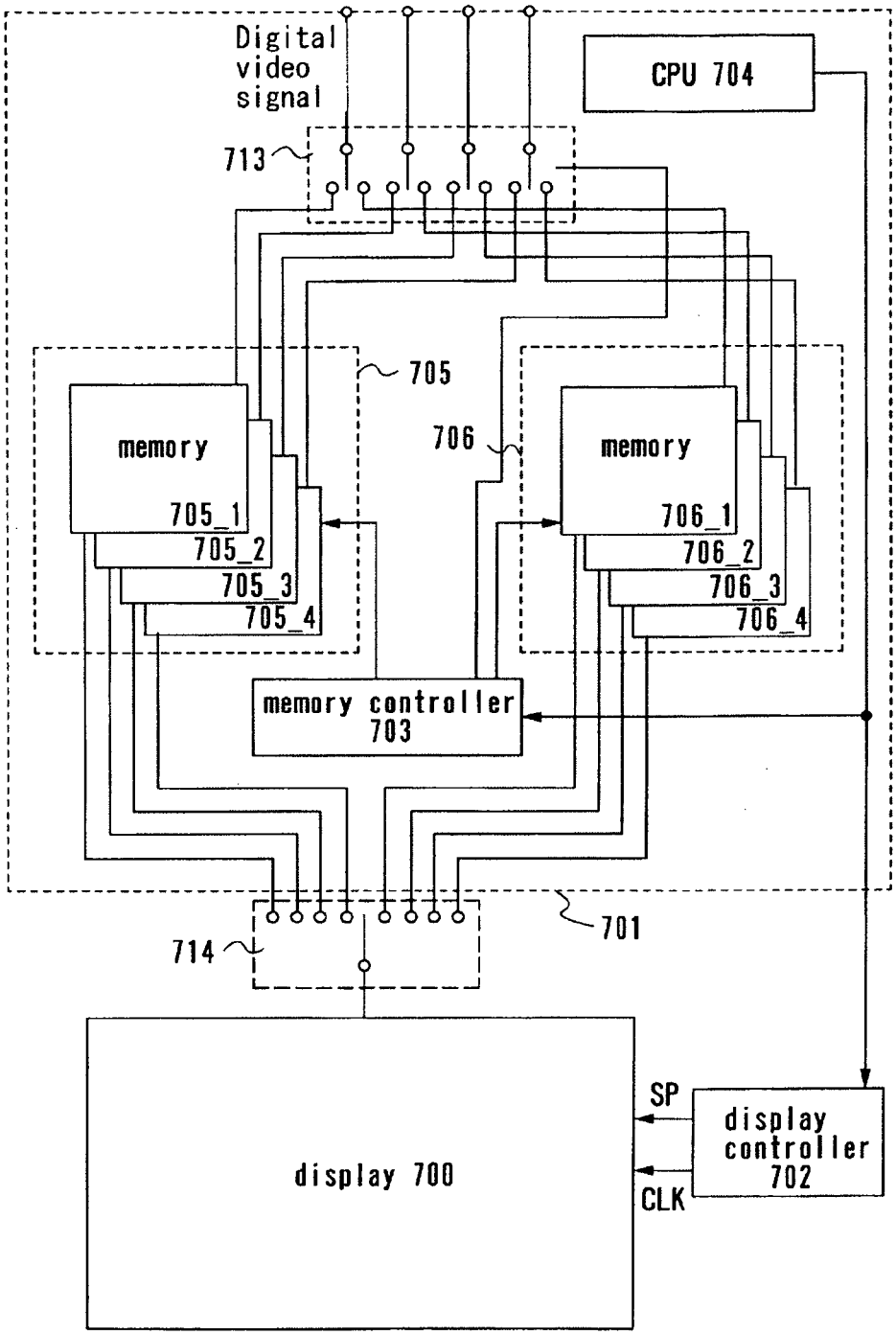
FIG. 8 is a block diagram of a controller.

Description is made on a circuit for supplying a signal for performing a time gray scale driving method to a source driver circuit and a gate driver circuit of a display with reference to FIGS. 7 and 8.

In this specification, a video signal inputted to a display device is called a digital video signal. Note that here, description is made on a display device in which a digital video signal of 4 bits is inputted to display an image as an example. However, the invention is not limited to 4 bits.

A digital video signal is read to a signal control circuit 701 and a digital video signal (VD) is outputted to a display 700. In addition, in this specification, a digital video signal which is edited in the signal control circuit to be converted to a signal to be inputted in the display is called the digital video signal. Signals for driving a source driver circuit 707 and a gate driver circuit 708 in the display 700 are inputted by a display controller 702.

Description is made on a configuration of the signal control circuit 701 and the display controller 702. Note that the source driver circuit 707 in the display 700 is formed of a shift register 710, an LAT (A) 711, and an LAT (B) 712. Although not shown, a level shifter, a buffer, or the like may be provided in addition. Moreover, the invention is not limited to such a configuration.

The signal control circuit 701 is formed of a CPU 704, a memory 705, a memory 706, and a memory controller 703. Details of the signal control circuit 701 are shown in FIG. 8.

A digital video signal inputted to the signal control circuit 701 is inputted to the memory 705 through a switch 713 controlled by the memory controller 703. Here, the memory 705 has capacitance which can store a digital video signal of 4 bits for all pixels of a pixel portion 709 of the display 700. After a signal for one frame period is stored in the memory 705, a signal of each bit is read sequentially by the memory controller 703. The digital video signal VD is inputted to the display 700 through a switch 714.

When the reading of the signal stored in the memory 705 starts, a digital video signal corresponding to the next frame period is inputted to the memory 706 through the switch 713 and starts to be stored. Similarly to the memory 705, the memory 706 has capacitance which can store a digital video signal of 4 bits for all pixels of the display device. After a signal for one frame period is stored in the memory 706, a signal of each bit is read sequentially by the memory controller 703. The digital video signal VD is inputted to the display 700 through the switch 714. When the reading of the signal stored in the memory 706 starts, the next writing starts in the memory 705. This is repeated so that a signal is supplied to the display.

In this manner, the signal control circuit 701 has the memory 705 and the memory 706 each of which can store a digital video signal of 4 bits for one frame period, and the memory 705 and the memory 706 are used alternately to supply a digital video signal to the display 700.

Here, described is the signal control circuit 701 in which a signal is stored using two memories of the memory 705 and the memory 706 alternately. However, in general, a signal control circuit has memories which can store information for a plurality of frames and uses these memories alternately so that a signal required for time gray scale display can be obtained.

This embodiment can be freely combined with Embodiment Mode, Embodiment 1, and Embodiment 2.

Embodiment 4

A format of QVGA is widely used in a mobile phone. Therefore, when the format of QVGA can be used, software for QVGA can be used as it is; therefore, new software development is not required, and development cost can be reduced. In addition, a user can obtain a function similar to a mobile phone which is usually used so that convenience is improved.

Therefore, according to the invention, a video signal is processed by software of QVGA, and after that, data of QVGA is developed to be a high resolution mode such as HVGA (half VGA), VGA, or SVGA with format conversion, so that a high resolution display is used and an image of QVGA can be obtained.

Figure 10:
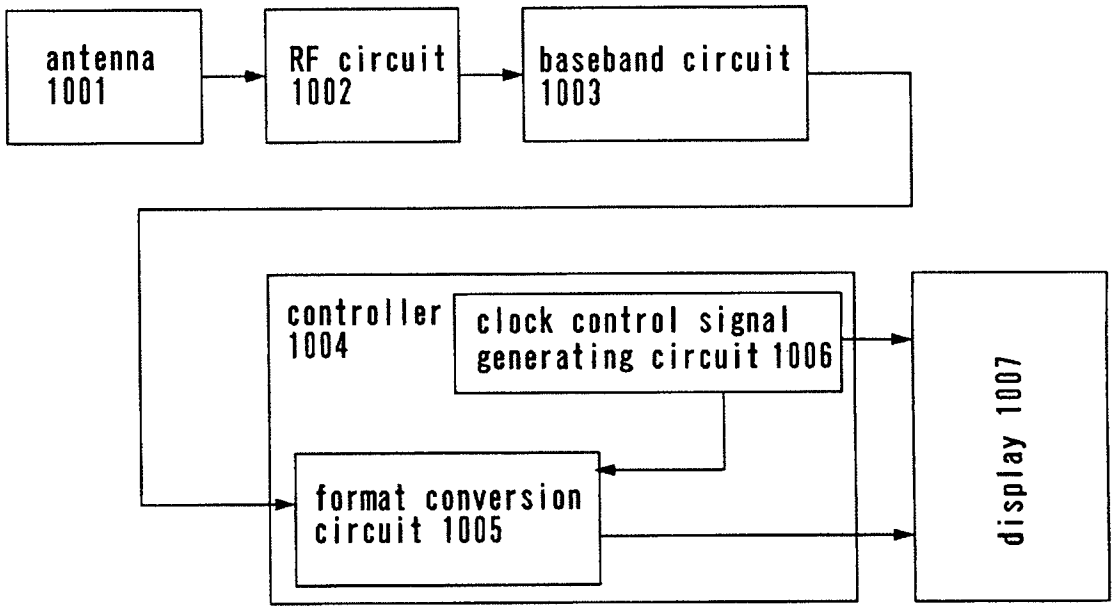
FIG. 10 is a block diagram of a mobile phone using an embodiment of the invention.

FIG. 10 shows a block diagram of a set. Each block is composed of an antenna 1001, an RF circuit 1002, a baseband circuit 1003, a controller 1004, and a display 1007. A baseband part for QVGA is used so that a system of a mobile phone can be used as it is. A format conversion circuit 1005 and a clock control signal generating circuit 1006 are provided inside the controller 1004, and a signal transmitted from the baseband circuit 1003 is converted from QVGA to another signal.

Figure 11:
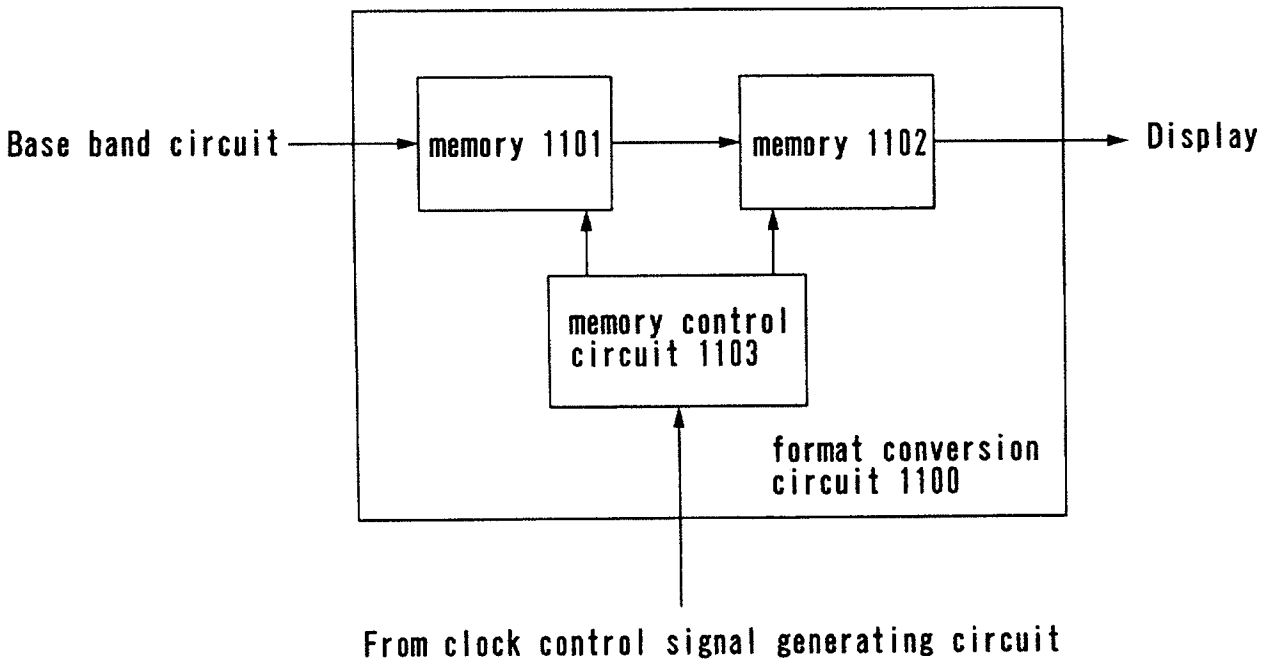
FIG. 11 is a block diagram of a format conversion circuit using an embodiment of the invention.

FIG. 11 shows as an embodiment of format conversion. FIG. 11 is composed of a memory 1101, a memory 1102, and a memory control circuit 1103. First, a signal transmitted from the baseband circuit is stored in the memory 1101. Next, arrangement is changed and data is transferred to the memory 1102. The memory control circuit 1103 controls timings of the memory 1101 and the memory 1102.

Next, description is made on an operation for performing conversion as shown in FIGS. 12A and 12B. Since the number of pixels of QVGA is 240×320 and the number of pixels of VGA is 480×640, both length and breadth are required to be doubled in order to perform conversion from QVGA to VGA. As the converting operation for length and breadth, the same data is read from the memory 1101 twice and written in the memory 1102 so that format conversion is possible.

A screen of QVGA is divided into a unit of 2 pixels×2 pixels as shown in FIG. 12A. When the unit of 2 pixels×2 pixels is transmitted from the memory 1101 to the memory 1102, each pixel data is read four times to make data of 4×4 as shown in FIG. 12B. In this manner, image data which is used for a display, having data of 2 times as large in both length and breadth can be formed.

Next, in a case where conversion is performed from QVGA to SVGA, since the number of pixels of QVGA is 240×320 and the number of pixels of SVGA is 600×800, both length and breadth are required to be 2.5 times as large. In this case, since there is only a case of integral multiples when the number of readings is simply increased, the following method is implemented.

A screen of QVGA is divided into a unit of 2 pixels×2 pixels as shown in FIG. 13A. When the unit of 2 pixels×2 pixels is transmitted from the memory 1101 to the memory 1102, the number of readings of each pixel is changed per frame so that the data amount can be 2.5 times as large.

First, in a first frame, as shown in FIG. 13B, data of a pixel A is read nine times, data of a pixel B is read six times, data of a pixel C is read six times, and data of a pixel D is read four times from the memory 1101, and stored in the memory 1102.

Next, in a second frame, as shown in FIG. 13C, the data of the pixel A is read six times, the data of the pixel B is read nine times, the data of the pixel C is read four times, and the data of the pixel D is read six times from the memory 1101, and stored in the memory 1102.

Next, in a third frame, as shown in FIG. 13D, the data of the pixel A is read six times, the data of the pixel B is read four times, the data of the pixel C is read nine times, and the data of the pixel D is read six times from memory 1101, and stored in the memory 1102.

Next, in a fourth frame, as shown in FIG. 13E, the data of the pixel A is read four times, the data of the pixel B is read six times, the data of the pixel C is read six times, and the data of the pixel D is read nine times from the memory 1101, and stored in the memory 1102.

Consequently, during the period of the first frame to the fourth frame, reading is performed 25 times in total for each pixel, and reading is performed at an average of 6.25 times. Length and breadth become 2.5 times as large respectively. In this manner, image data which is used for a display method, having data of 2.5 times as large in both length and breadth can be formed.

Next, in a case where conversion is performed from QVGA to HVGA, since the number of pixels of QVGA is 240×320 and the number of pixels of HVGA is 320×480, both length and breadth are required to be 1.333 times or larger. In this case, since there are only integral multiples in a case where the number of readings is simply increased, the following methods are implemented. Moreover, since a screen aspect ratio of HVGA is not 3:4, there is a region that display cannot be performed partially; however, in this case, the portion is dealt such as black display.

A display of QVGA is divided into a unit of 3 pixels×3 pixels as shown in FIG. 14A. When the unit of 3 pixels×3 pixels is transmitted from the memory 1101 to the memory 1102, the number of readings of each pixel is changed per frame so that the data amount can be 1.333 times as large.

First, in a first frame, as shown in FIG. 14B, data of a pixel A is read four times, data of a pixel B is read twice, data of a pixel C is read twice, data of a pixel D is read twice, data of a pixel E is read once, data of a pixel F is read once, data of a pixel G is read twice, data of a pixel H is read once, and data of a pixel I is read once from the memory 1101, and stored in the memory 1102.

Next, in a second frame, as shown in FIG. 14C, the data of the pixel A is read twice, the data of the pixel B is read four times, the data of the pixel C is read twice, the data of the pixel D is read once, the data of the pixel E is read twice, the data of the pixel F is read once, the data of the pixel G is read once, the data of the pixel H is read twice, and the data of the pixel I is read once from the memory 1101, and stored in the memory 1102.

Next, in a third frame, as shown in FIG. 14D, the data of the pixel A is read twice, the data of the pixel B is read twice, the data of the pixel C is read four times, the data of the pixel D is read once, the data of the pixel E is read once, the data of the pixel F is read twice, the data of the pixel G is read once, the data of the pixel H is read once, and the data of the pixel I is read twice from the memory 1101, and stored in the memory 1102.

Next, in a fourth frame, as shown in FIG. 14E, the data of the pixel A is read twice, the data of the pixel B is read once, the data of the pixel C is read once, the data of the pixel D is read four times, the data of the pixel E is read twice, the data of the pixel F is read twice, the data of the pixel G is read twice, the data of the pixel H is read once, and the data of the pixel I is read once from the memory 1101, and stored in the memory 1102.

Next, in a fifth frame, as shown in FIG. 14F, the data of the pixel A is read once, the data of the pixel B is read twice, the data of the pixel C is read once, the data of the pixel D is read twice, the data of the pixel E is read four times, the data of the pixel F is read twice, the data of the pixel G is read once, the data of the pixel H is read twice, and the data of the pixel I is read once from the memory 1101, and stored in the memory 1102.

Next, in a sixth frame, as shown in FIG. 14G, the data of the pixel A is read once, the data of the pixel B is read once, the data of the pixel C is read twice, the data of the pixel D is read twice, the data of the pixel E is read twice, the data of the pixel F is read four times, the data of the pixel G is read once, the data of the pixel H is read once, and the data of the pixel I is read twice from the memory 1101, and stored in the memory 1102.

Next, in a seventh frame, as shown in FIG. 14H, the data of the pixel A is read twice, the data of the pixel B is read once, the data of the pixel C is read once, the data of the pixel D is read twice, the data of the pixel E is read once, the data of the pixel F is read once, the data of the pixel G is read four times, the data of the pixel H is read twice, and the data of the pixel I is read twice from the memory 1101, and stored in the memory 1102.

Next, in an eighth frame, as shown in FIG. 14I, the data of the pixel A is read once, the data of the pixel B is read twice, the data of the pixel C is read once, the data of the pixel D is read once, the data of the pixel E is read twice, the data of the pixel F is read once, the data of the pixel G is read twice, the data of the pixel H is read four times, and the data of the pixel I is read twice from the memory 1101, and stored in the memory 1102.

Next, in a ninth frame, as shown in FIG. 14J, the data of the pixel A is read once, the data of the pixel B is read once, the data of the pixel C is read twice, the data of the pixel D is read once, the data of the pixel E is read once, the data of the pixel F is read twice, the data of the pixel G is read twice, the data of the pixel H is read twice, and the data of the pixel I is read four times from the memory 1101, and stored in the memory 1102.

Consequently, during the period of the first frame to the ninth frame, reading is performed 16 times in total for each pixel, and reading is performed at an average of 1.777 times. Length and breadth become 1.333 times as large respectively. In this manner, image data which is used for a display method, having data of 1.333 times as large in both length and breadth can be formed.

In this manner, conversion from QVGA to VGA, SVGA, or HVGA can be performed. Note that a method of format conversion is not limited to the aforementioned method, another method may be used.

This embodiment can be freely combined with Embodiment Mode, Embodiment 1 to Embodiment 3.

Embodiment 5

An electronic apparatus of the invention is described with reference to FIGS. 9A to 9G.

Figure 9A:
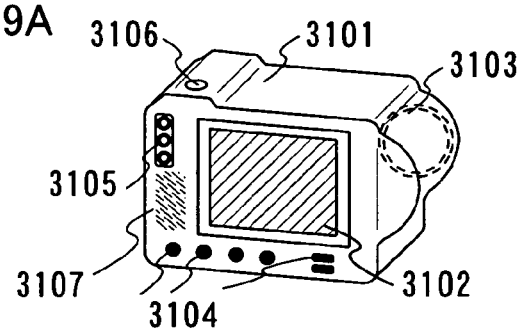
FIGS. 9A to 9G are views each showing an embodiment of an electronic apparatus using the invention.

FIG. 9A shows a digital camera including a main body 3101, a display portion 3102, an image receiving portion 3103, operation keys 3104, an external connection port 3105, a shutter 3106, an audio output portion 3107, and the like. In this digital camera, the display portion 3102 is provided with a pixel similar to the pixel described in Embodiment Mode or Embodiments 1 to 4. That is, as a pixel configuration, arrangement of elements is effectively performed while a delta arrangement is performed, even when one or more of static memories or the like are arranged in one pixel, parasitic resistance of a wire and parasitic capacitance of a wire can be reduced and the increase of delay time can be suppressed. Moreover, arrangement of an element and a wire can be easy. With such characteristics, low power consumption can be achieved in a digital camera. Therefore, a battery can be miniaturized and a digital camera which is light-weight and thin can be provided. In addition, both of a moving image and a still image can be displayed with high quality.

Figure 9B:
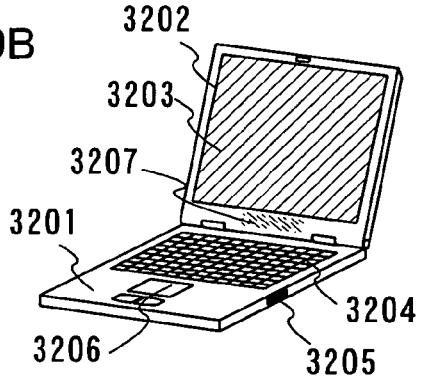

FIG. 9B shows a computer including a main body 3201, a housing 3202, a display portion 3203, a keyboard 3204, an external connection port 3205, a pointing mouse 3206, an audio output portion 3207, and the like. In this computer, the display portion 3203 is provided with a pixel similar to the pixel described in Embodiment Mode or Embodiments 1 to 4. That is, as a pixel configuration, arrangement of elements is effectively performed while a delta arrangement is performed, even when one or more of static memories or the like are arranged in one pixel, parasitic resistance of a wire and parasitic capacitance of a wire can be reduced and the increase of delay time can be suppressed. Moreover, arrangement of an element and a wire can be easy. With such characteristics, low power consumption can be achieved in a computer. Therefore, a battery can be miniaturized and a computer which is light-weight and thin can be provided. Moreover, in a case where a battery with the same capacitance is mounted, usable time without charging can be extended. In addition, both of a moving image and a still image can be displayed with high quality.

Figure 9C:
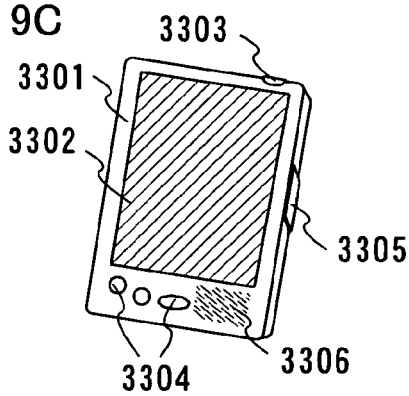

FIG. 9C shows a portable information terminal device including a main body 3301, a display portion 3302, a switch 3303, operation keys 3304, an infrared port 3305, an audio output portion 3306, and the like. In this portable information terminal, the display portion 3302 is provided with a pixel similar to the pixel described in Embodiment Mode or Embodiments 1 to 4. That is, as a pixel configuration, arrangement of elements is effectively performed while a delta arrangement is performed, even when one or more of static memories or the like are arranged in one pixel, parasitic resistance of a wire and parasitic capacitance of a wire can be reduced and the increase of delay time can be suppressed. Moreover, arrangement of an element and a wire can be easy. With such characteristics, low power consumption can be achieved in a portable information terminal device. Therefore, a battery can be miniaturized and a portable information terminal device which is reduced in size and weight can be provided. Moreover, in a case where a battery with the same capacitance is mounted, usable time without charging can be extended. In addition, both of a moving image and a still image can be displayed with high quality.

Figure 9D:
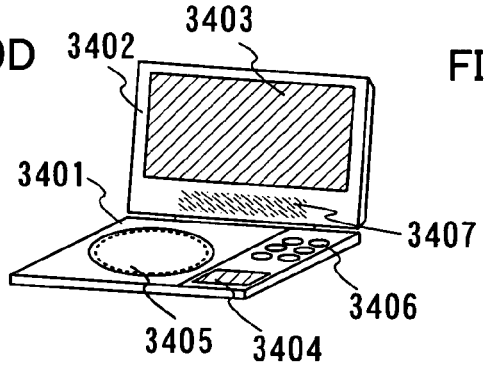

FIG. 9D shows an image reproducing device (specifically, a DVD reproducing unit) provided with a recording medium reading portion, including a main body 3401, a housing 3402, a recording medium (a CD, an LD, a DVD, or the like) reading portion 3405, an operation key 3406, a display portion (a) 3403, a display portion (b) 3404, an audio output portion 3407, and the like. In this image reproducing device, the display portion (a) 3403 and the display portion (b) 3404 are provided with a pixel similar to the pixel described in Embodiment Mode or Embodiments 1 to 4. That is, as a pixel configuration, arrangement of elements is effectively performed while a delta arrangement is performed, even when one or more of static memories or the like are arranged in one pixel, parasitic resistance of a wire and parasitic capacitance of a wire can be reduced and the increase of delay time can be suppressed. Moreover, arrangement of an element and a wire can be easy. With such characteristics, low power consumption can be achieved in an image reproducing device. Therefore, a battery can be miniaturized and an image reproducing device which is reduced in size and weight can be provided. Moreover, in a case of using in a battery mode, long-time reproduction is possible, and time during which an image can be appreciated can be extended.

Figure 9E:
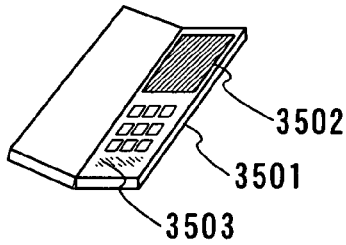

FIG. 9E shows a folding portable display device, and a display portion 3502 and an audio output portion 3503 are provided to a main body 3501. In this portable display device, the display portion 3502 is provided with a pixel similar to the pixel described in Embodiment Mode or Embodiments 1 to 4. That is, as a pixel configuration, arrangement of elements is effectively performed while a delta arrangement is performed, even when one or more of static memories or the like are arranged in one pixel, parasitic resistance of a wire and parasitic capacitance of a wire can be reduced and the increase of delay time can be suppressed. Moreover, arrangement of an element and a wire can be easy. With such characteristics, low power consumption can be achieved in a portable display device. Therefore, a battery can be miniaturized, and reduction in size and weight of the main body 3501 can be achieved.

Figure 9F:
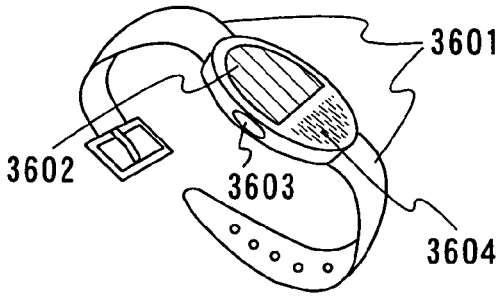

FIG. 9F shows a wrist watch including bands 3601, a display portion 3602, an operating switch 3603, an audio output portion 3604, and the like. In this wrist watch, the display portion 3602 is provided with a pixel similar to the pixel described in Embodiment Mode or Embodiments 1 to 4. That is, as a pixel configuration, arrangement of elements is effectively performed while a delta arrangement is performed, even when one or more of static memories or the like are arranged in one pixel, parasitic resistance of a wire and parasitic capacitance of a wire can be reduced and the increase of delay time can be suppressed. Moreover, arrangement of an element and a wire can be easy. With such characteristics, low power consumption can be achieved in a wrist watch. Therefore, a battery can be miniaturized, and a wrist watch which is reduced in size and weight can be provided.

Figure 9G:
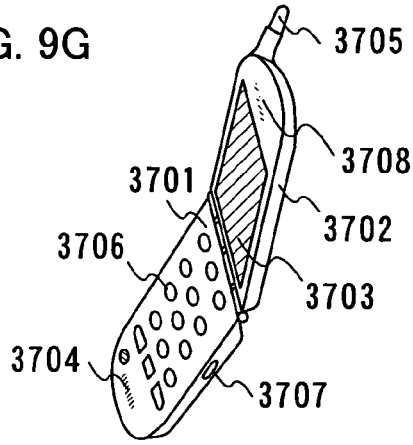

FIG. 9G shows a mobile phone device including a main body 3701, a housing 3702, a display portion 3703, an audio input portion 3704, an antenna 3705, an operation key 3706, an external connection port 3707, an audio output portion 3708, and the like. In this mobile phone device, the display portion 3703 is provided with a pixel similar to the pixel described in Embodiment Mode or Embodiments 1 to 4. That is, as a pixel configuration, arrangement of elements is effectively performed while a delta arrangement is performed, even when one or more of static memories or the like are arranged in one pixel, parasitic resistance of a wire and parasitic capacitance of a wire can be reduced and the increase of delay time can be suppressed. Moreover, arrangement of an element and a wire can be easy. With such characteristics, low power consumption can be achieved in a mobile phone device. Therefore, a battery can be miniaturized and a mobile phone device which is reduced in weight can be provided. Moreover, in a case where a battery at the same capacitance is mounted, usable time without charging can be extended. In addition, both of a moving image and a still image can be displayed with high quality.

As set forth above, application range of the invention is extremely wide and the invention can be applied to electronic apparatuses of every field.

Note that this embodiment can be freely combined with Embodiment Mode, Embodiment 1 to Embodiment 4.

This application is based on Japanese Patent Application serial no. 2005-104455 filed in Japan Patent Office on Mar. 31, in 2005, the entire contents of which are hereby incorporated by reference.

What is claimed is:

1. A display device having a plurality of display elements comprising:

a plurality of pixel electrodes over a substrate;

a plurality of pixel driving elements including a first pixel driving element, each of the pixel driving elements having a first transistor, a second transistor, a third transistor, a first inverter and a second inverter;

a first line electrically connected to a gate electrode of the first transistor and a gate electrode of the third transistor in the first pixel driving element;

a second line electrically connected to one of a source electrode and a drain electrode of the first transistor in the first pixel driving element;

a third line parallel to the first line; and a fourth line connected to the first inverter and the second inverter in the first pixel driving element, wherein one of a source electrode and a drain electrode of the third transistor in the first pixel driving element is electrically connected to an output terminal of the second inverter in the first pixel driving element, wherein the output terminal of the second inverter in the first pixel driving element is electrically connected to a gate electrode of the second transistor in the first pixel driving element, wherein the other of the source electrode and the drain electrode of the third transistor in the first pixel driving element is electrically connected to an input terminal of the first inverter in the first pixel driving element, wherein a connection between the output terminal of the second inverter in the first pixel driving element and the input terminal of the first inverter in the first pixel driving element is configured to be controlled by the third transistor in the first pixel driving element, wherein an output terminal of the first inverter in the first pixel driving element is electrically connected to an input terminal of the second inverter in the first pixel driving element, wherein the other of the source electrode and the drain electrode of the first transistor in the first pixel driving element is directly connected to the input terminal of the first inverter in the first pixel driving element, wherein one of a source electrode and a drain electrode of the second transistor in the first pixel driving element is electrically connected to one of the pixel electrodes, wherein first signals having two levels are alternately applied to the third line, wherein the potential of the one of the pixel electrodes is controlled by the first signals and controlled by an output signal of the second inverter in the first pixel driving element, wherein each of the plurality of pixel driving elements further includes a fourth transistor and a fifth transistor, wherein the other of the source electrode and the drain electrode of the second transistor in the first pixel driving element is electrically connected to the fourth line, wherein one of a source electrode and a drain electrode of the fourth transistor in the first pixel driving element is electrically connected to the output terminal of the second inverter in the first pixel driving element, wherein a gate electrode of the fourth transistor in the first pixel driving element is electrically connected to the third line, wherein one of a source electrode and a drain electrode of the fifth transistor in the first pixel driving element is electrically connected to the fourth line, wherein a gate electrode of the fifth transistor in the first pixel driving element is electrically connected to the third line, wherein the other of the source electrode and the drain electrode of the fourth transistor in the first pixel driving element is electrically connected to the gate electrode of the second transistor in the first pixel driving element, and wherein the other of the source electrode and the drain electrode of the fifth transistor in the first pixel driving element is electrically connected to the gate electrode of the second transistor in the first pixel driving element.

2. An electronic apparatus selected from group consisting of a computer, a camera, a portable information terminal device, an image reproducing device, a watch, and a mobile phone using the display device according to claim 1.

3. The display device according to claim 1, wherein a light emitting layer is provided over the pixel electrodes.

4. A display device having a plurality of display elements comprising:

a plurality of pixel electrodes over a substrate;

a plurality of pixel driving elements including a first pixel driving element, each of the pixel driving elements having a first transistor, a second transistor, a third transistor, a first inverter and a second inverter;

a first line;

a second line;

a third line; and a fourth line connected to the first inverter and the second inverter in the first pixel driving element, wherein the first transistor in the first pixel driving element is configured to be on when the third transistor in the first pixel driving element is off and the first transistor in the first pixel driving element is configured to be off when the third transistor in the first pixel driving element is on, wherein an output signal of the first inverter in the first pixel driving element is configured to be entered to an input terminal of the second inverter in the first pixel driving element, wherein the first transistor in the first pixel driving element is provided between the second line and an input terminal of the first inverter in the first pixel driving element, wherein the second line and the input terminal of the first inverter in the first pixel driving element is always short-circuited whenever the first transistor is on, wherein both a source electrode and a drain electrode of the third transistor in the first pixel driving element is provided between an output terminal of the second inverter in the first pixel driving element and the input terminal of the first inverter in the first pixel driving element, wherein a connection between the output terminal of the second inverter in the first pixel driving element and the input terminal of the first inverter in the first pixel driving element is configured to be controlled by the third transistor in the first pixel driving element, wherein the second transistor in the first pixel driving element is provided between the second inverter and one of the pixel electrodes, wherein first signals having two levels are alternately applied to the third line, and the potential of the one of the pixel electrodes is controlled by the first signals and controlled by an output signal of the second inverter in the first pixel driving element, wherein each of the plurality of pixel driving elements further includes a fourth transistor and a fifth transistor, wherein both of a source electrode and a drain electrode of the second transistor are provided between the one of the pixel electrodes and the fourth line, wherein the fourth transistor in the first pixel driving element is configured to be on when the fifth transistor in the first pixel driving element is off and the fourth transistor in the first pixel driving element is configured to be off when the fifth transistor in the first pixel driving element is on, wherein both of the fourth transistor in the first pixel driving element and the fifth transistor in the first pixel driving element are configured to be controlled by the first signals of the third line, wherein both of a source electrode and drain electrode of the fourth transistor in the first pixel driving element are provided between the output terminal of the second inverter in the first pixel driving element and the second transistor in the first pixel driving element, wherein both of a source electrode and a drain electrode of the fifth transistor in the first pixel driving element are provided between the fourth line and the second transistor in the first pixel driving element, wherein a connection between the output terminal of the second inverter in the first pixel driving element and the second transistor in the first pixel driving element is configured to be controlled by the fourth transistor in the first pixel driving element, and wherein a connection between the fourth line and the second transistor in the first pixel driving element is configured to be controlled by the fourth transistor in the first pixel driving element.

5. The display device according to claim 4, wherein a light emitting layer is provided over the pixel electrodes.

6. An electronic apparatus selected from group consisting of a computer, a camera, a portable information terminal device, an image reproducing device, a watch, and a mobile phone using the display device according to claim 4.

7. A display device having a plurality of display elements comprising:

a plurality of pixel electrodes over a substrate;

a plurality of pixel driving elements including a first pixel driving element, each of the pixel driving elements having a first switching element, a second switching element, a third switching element, a first inverter and a second inverter;

a first line configured to control the first switching element and the third switching element in the first pixel driving element;

a second line electrically connected to one terminal of the first switching element in the first pixel driving element;

a third line parallel to the first line; and a fourth line connected to the first inverter and the second inverter in the first pixel driving element, wherein one terminal of the third switching element in the first pixel driving element is electrically connected to an output terminal of the second inverter in the first pixel driving element, wherein the other terminal of the third switching element in the first pixel driving element is electrically connected to an input terminal of the first inverter in the first pixel driving element, wherein a connection between the output terminal of the second inverter in the first pixel driving element and the input terminal of the first inverter in the first pixel driving element is configured to be controlled by the third switching element in the first pixel driving element, wherein an output terminal of the first inverter in the first pixel driving element is electrically connected to an input terminal of the second inverter in the first pixel driving element, wherein the other terminal of the first switching element in the first pixel driving element is directly connected to the input terminal of the first inverter in the first pixel driving element, wherein one terminal of the second switching element in the first pixel driving element is electrically connected to one of the pixel electrodes, wherein first signals having two levels are alternately applied to the third line, wherein the potential of the one of the pixel electrodes is controlled by the first signals and controlled by an output signal of the second inverter in the first pixel driving element, wherein each of the plurality of pixel driving elements further includes a fourth switching element and a fifth switching element, wherein the other terminal of the second switching element in the first pixel driving element is electrically connected to the fourth line, wherein the fourth switching element in the first pixel driving element is configured to be on when the filth switching element in the first pixel driving element is off and the fourth switching element in the first pixel driving element is configured to be off when the fifth switching element in the first pixel driving element is on, wherein one terminal of the fourth switching element in the first pixel driving element is electrically connected to the output terminal of the second inverter in the first pixel driving element, wherein the third line is configured to control the fourth switching element and the fifth switching element in the first pixel driving element, wherein one terminal of the fifth switching element in the first pixel driving element is electrically connected to the fourth line, wherein the other terminal of the fourth switching element in the first pixel driving element is electrically connected to the other terminal of the fifth switching element in the first pixel driving element, and wherein the second switching element in the first pixel driving element is configured to be controlled by the potential of the other terminal of the fifth switching element in the first pixel driving element.

8. The display device according to claim 7, wherein a light emitting layer is provided over the pixel electrodes.

9. The display device according to claim 7, wherein each of the first switching element, the second switching element and the third switching element is a transistor.

10. An electronic apparatus selected from group consisting of a computer, a camera, a portable information terminal device, an image reproducing device, a watch, and a mobile phone using the display device according to claim 7.

11. A display device having a plurality of display elements comprising:

a plurality of pixel electrodes over a substrate;

a plurality of pixel driving elements including a first pixel driving element, each of the pixel driving elements having a first switching element, a second switching element, a third switching element, a first inverter and a second inverter;

a first line;

a second line;

a third line; and a fourth line connected to the first inverter and the second inverter in the first pixel driving element, wherein the first switching element in the first pixel driving element is configured to be on when the third switching element in the first pixel driving element is off and the first switching element in the first pixel driving element is configured to be off when the third switching element in the first pixel driving element is on, wherein an output signal of the first inverter in the first pixel driving element is configured to be entered to an input terminal of the second inverter in the first pixel driving element, wherein the first switching element in the first pixel driving element is provided between the second line and an input terminal of the first inverter in the first pixel driving element, wherein the second line and the input terminal of the first inverter in the first pixel driving element is always short-circuited whenever the first switching element is on, wherein the third switching element in the first pixel driving element comprises a first terminal and a second terminal both of which are provided between an output terminal of the second inverter in the first pixel driving element and the input terminal of the first inverter in the first pixel driving element, wherein a connection between the output terminal of the second inverter in the first pixel driving element and the input terminal of the first inverter in the first pixel driving element is configured to be controlled by the third switching element in the first pixel driving element, wherein the second switching element in the first pixel driving element is provided between the second inverter and one of the pixel electrodes, wherein first signals having two levels are alternately applied to the third line, and the potential of the one of the pixel electrodes is controlled by the first signals and controlled by an output signal of the second inverter in the first pixel driving element, wherein each of the plurality of pixel driving elements further includes a fourth switching element and a fifth switching element, wherein the second switching element in the first pixel driving element comprises a first terminal and a second terminal both of which are provided between the one of the pixel electrodes and the fourth line, wherein the fourth switching element in the first pixel driving element is configured to be on when the fifth switching element in the first pixel driving element is off and the fourth switching element in the first pixel driving element is configured to be off when the fifth switching element in the first pixel driving element is on, wherein both of the fourth switching element in the first pixel driving element and the fifth switching element in the first pixel driving element are configured to be controlled by the first signals of the third line, wherein the fourth switching element in the first pixel driving element comprises a first terminal and a second terminal both of which are provided between the output terminal of the second inverter in the first pixel driving element and a first terminal of the fifth switching element in the first pixel driving element, wherein the fifth switching element in the first pixel driving element comprises the first terminal and a second terminal both of which are provided between the fourth line and the second terminal of the fourth switching element in the first pixel driving element, wherein a connection between the output terminal of the second inverter in the first pixel driving element and the first terminal of the fifth switching element in the first pixel driving element is configured to be controlled by the fourth switching element in the first pixel driving element, wherein a connection between the fourth line and the second terminal of the fourth switching element in the first pixel driving element is configured to be controlled by the fourth switching element in the first pixel driving element, and wherein the potential of the second terminal of the fourth switching element in the first pixel driving element and the potential of the first terminal of the fifth switching element in the first pixel driving element are always substantially identical, and the second switching element in the first pixel driving element is configured to be controlled by the potential of the second terminal of the fourth switching element in the first pixel driving element.

12. The display device according to claim 11, wherein a light emitting layer is provided over the pixel electrodes.

13. The display device according to claim 11, wherein each of the first switching element, the second switching element and the third switching element is a transistor.

14. An electronic apparatus selected from group consisting of a computer, a camera, a portable information terminal device, an image reproducing device, a watch, and a mobile phone using the display device according to claim 11.

* * * * *